US011536106B2

(12) United States Patent
Evans

(10) Patent No.: US 11,536,106 B2
(45) **Date of Patent: *Dec. 27, 2022**

(54) PREDETERMINED LOAD RELEASE DEVICE FOR A JAR

(71) Applicant: Evans Engineering & Manufacturing, Inc., Conroe, TX (US)

(72) Inventor: Robert W. Evans, Montgomery, TX (US)

(73) Assignee: Robert W. Evans, Montgomery, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/229,575

(22) Filed: Apr. 13, 2021

(65) Prior Publication Data

US 2021/0230958 A1 Jul. 29, 2021

Related U.S. Application Data

(63) Continuation of application No. 16/255,315, filed on Jan. 23, 2019, now Pat. No. 10,975,649, which is a continuation of application No. 14/618,074, filed on Feb. 10, 2015, now Pat. No. 10,208,554.

(51) Int. Cl.
*E21B 31/107* (2006.01)

(52) U.S. Cl.
CPC ..... *E21B 31/107* (2013.01)

(58) Field of Classification Search
CPC ... E21B 31/107; E21B 31/113; E21B 31/1135
See application file for complete search history.

(56) References Cited

U.S. PATENT DOCUMENTS

| | | | | |
|---|---|---|---|---|
| 3,658,140 | A | 4/1972 | Berryman | |
| 3,685,598 | A | 8/1972 | Nutter | |
| 3,709,478 | A | 1/1973 | Kisling | |
| 4,109,736 | A | 8/1978 | Webb et al. | |
| 5,139,086 | A | 8/1992 | Griffith, Sr. | |
| 5,330,018 | A | 7/1994 | Griffith | |
| 6,254,071 | B1 * | 7/2001 | Greenhill | F16F 1/328 267/161 |
| 6,453,997 | B1 | 9/2002 | McNeilly et al. | |
| 6,481,495 | B1 * | 11/2002 | Evans | E21B 31/107 175/321 |
| 8,205,690 | B2 | 6/2012 | Evans | |
| 10,208,554 | B2 | 2/2019 | Evans | |
| 10,975,649 | B2 * | 4/2021 | Evans | E21B 31/107 |
| 2005/0145417 | A1 | 7/2005 | Radford et al. | |

(Continued)

OTHER PUBLICATIONS

USPTO Issue Notification for U.S. Appl. No. 14/618,074 dated Jan. 30, 2019.

(Continued)

*Primary Examiner* — Robert E Fuller
(74) *Attorney, Agent, or Firm* — Tumey L.L.P.

(57) ABSTRACT

A release device for a jarring tool includes a collet positioned between the mandrel of the jarring tool and a trigger sleeve. At least one end of the collet is in contact with a precompressed spring via a bushing. In order for the jarring tool to operate, a force greater than the precompressed force of the spring must be applied to the mandrel so that the collet can move in axial direction against the spring thereby releasing the mandrel.

7 Claims, 6 Drawing Sheets

(56) References Cited

U.S. PATENT DOCUMENTS

| | | | |
|---|---|---|---|
| 2006/0054322 | A1 | 3/2006 | Rose |
| 2012/0012303 | A1 | 1/2012 | Xu |
| 2013/0068533 | A1 | 3/2013 | Hradecky |

OTHER PUBLICATIONS

USPTO Notice of Allowance for U.S. Appl. No. 16/255,315 dated Dec. 17, 2020.
USPTO Issue Notification for U.S. Appl. No. 16/255,136 dated Mar. 24, 2021.
International Search Report and Written Opinion for Application No. PCT/US2016/014799 dated May 5, 2016.
International Preliminary Report on Patentability for Application No. PCT/US2016/014799 dated Aug. 15, 2017.
Non-Final Office Action for U.S. Appl. No. 14/618,074 dated Apr. 20, 2017.
Final Office Action for U.S. Appl. No. 14/618,074 dated Nov. 1, 2017.
Non-Final Office Action for U.S. Appl. No. 14/618,074 dated Jun. 5, 2018.
Notice of Allowance for Application No. 14/618,0774 dated Oct. 9, 2018.
Notice of Allowance for Application No. 14/618,0774 dated Oct. 29, 2018.
Non-Final Office Action for U.S. Appl. No. 16/255,315 dated May 15, 2020.

* cited by examiner

PREDETERMINED LOAD RELEASE DEVICE FOR A JAR

This application is a continuation of U.S. application Ser. No. 16/255,315 filed Jan. 23, 2019, which is a continuation of U.S. application Ser. No. 14/618,074 filed Feb. 10, 2015, issued as U.S. Pat. No. 10,208,554 on Feb. 19, 2019, each of which are incorporated by reference herein in their entirety.

BACKGROUND OF INVENTION

1. Field of the Invention

This invention relates to a release mechanism for a jarring device used in conjunction with the drilling and/or completion of oil or gas wells. Jarring devices are typically used in conjunction with drilling or completion tubular strings positioned within a well to impart an upward or downward force on a tool carried by the string should the tool or string become lodged within the well.

2. Description of Related Art

U.S. Pat. No. 5,139,086 discloses a double acting jar having a first end for connection to a work string and a second end 2 for connection to the tool which may become struck in the wellbore. The jar includes accumulator springs 4 and 5 which act to accumulate energy in two directions. Also disclosed are latch bars, bias spring 13 and bushings 12. The amount of force necessary to release jarring mandrel 2 is determined by the adjustment of bias spring 13 which acts on latch bars 11 via bushings 12. Latch bars 11 include ridges 17 which are positioned in a groove 16 on the jarring mandrel. The more compressive force applied to latch bars 11, more force is required to displace ridges 17 out of groove 16 thereby enabling the jarring mandrel to be released.

U.S. Pat. No. 5,330,018 discloses a similar latch mechanism including latch bars 160, ridges 170 and 182 and grooves 100 and 118 located in mandrel 100.

The release mechanisms of the prior art have the disadvantage of excessive wear and increased friction which reduces the effectiveness and reliability of the jar.

BRIEF SUMMARY OF THE INVENTION

The present invention overcomes the deficiencies of the prior art as discussed above by providing a predetermined release mechanism for a jar that reduces drag and wear to a minimum. Springs such as Belleville springs are compressed within a split housing. A collet is positioned between a jarring mandrel and a trigger sleeve. The trigger sleeve surrounds the collet and the mandrel. A force sufficient to overcome the force exerted by the springs is required before the mandrel is released thereby allowing the jar to operate.

BRIEF DESCRIPTION OF THE SEVERAL VIEWS OF THE DRAWING(S)

FIG. 1 is a partial cross-sectional view of a release device for a jar according to a first embodiment of the invention in a neutral position.

FIG. 1*a* is an enlargement of the dotted area labeled FIG. 1*a* in FIG. 1.

FIG. 2 is a partial cross-sectional view showing the mandrel in a released position.

FIG. 2*a* is an enlarged view of the area designed FIG. 2*a* in FIG. 2.

FIG. 3 is a partial cross-sectional view of a second embodiment according to the invention in a neutral position.

FIG. 3*a* is an enlargement of the area designated 3*a* in FIG. 3

Figure 5:
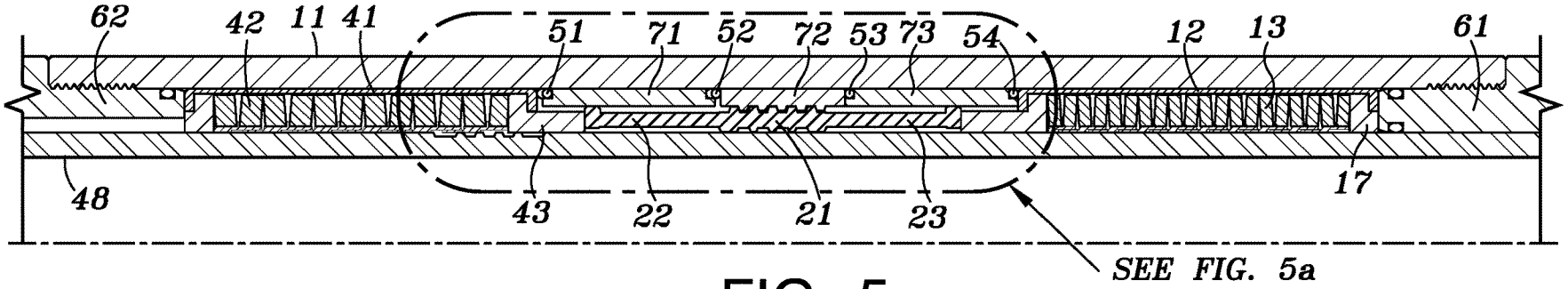
FIG. 5 is a cross-sectional view of the embodiment of FIG. 3 showing the mandrel in a released position.
Figure 5A:
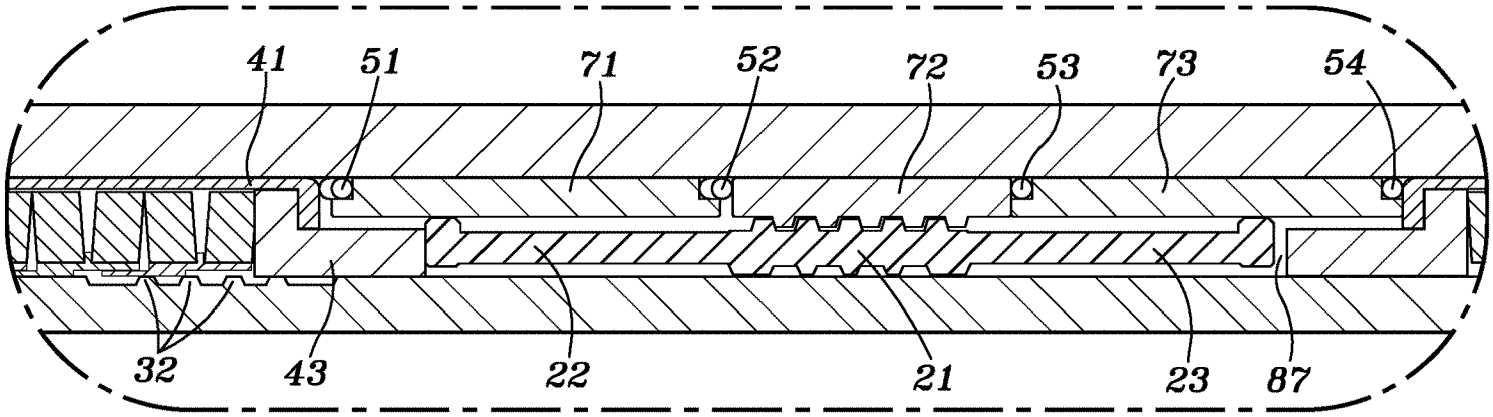

FIG. 5*a* is an enlarged view of the area designated 5*a* in FIG. 5.

Figure 6:
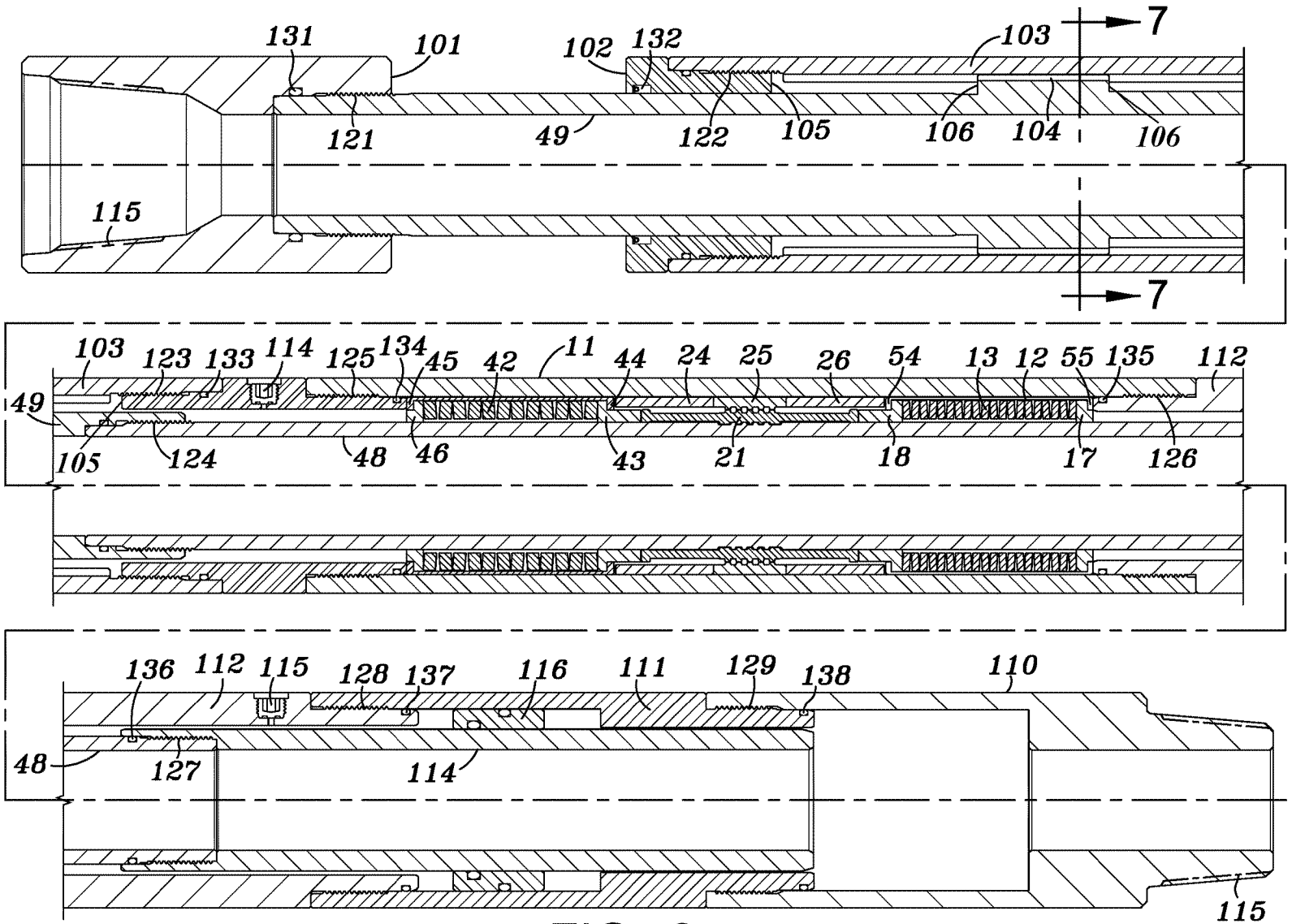

FIG. 6 is a cross-sectional view of a jarring tool according to an embodiment of the invention.

Figure 7:
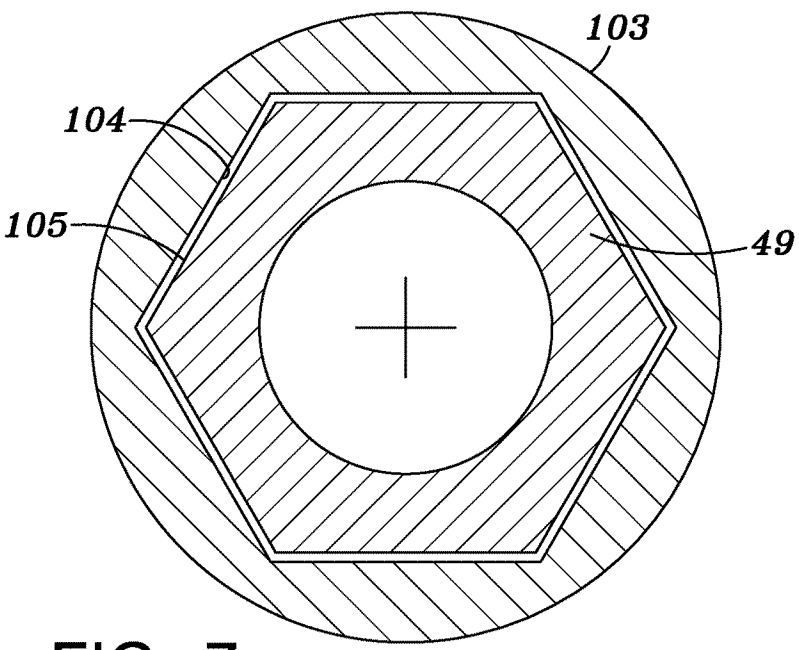

FIG. 7 is a cross-sectional view taken along line 7-7 of FIG. 6.

Figure 8:
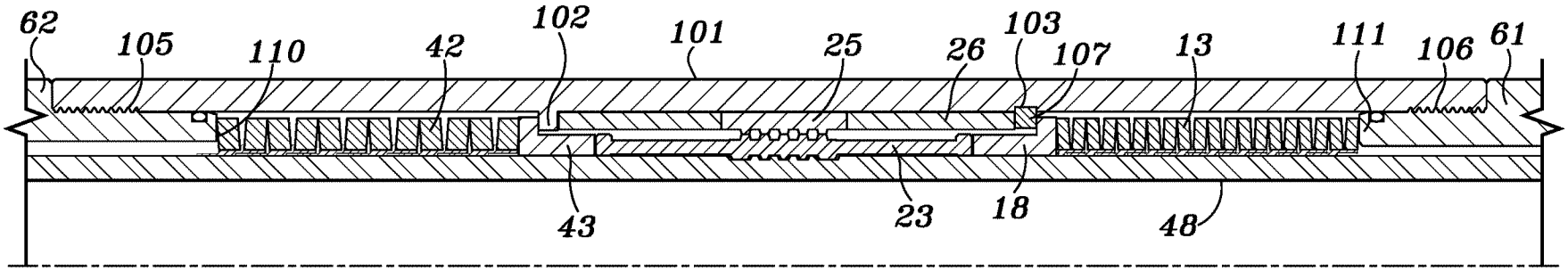

FIG. 8 is a partial cross-sectional view of a release device according to a third embodiment of the invention.

DETAILED DESCRIPTION OF THE INVENTION

Figure 1:
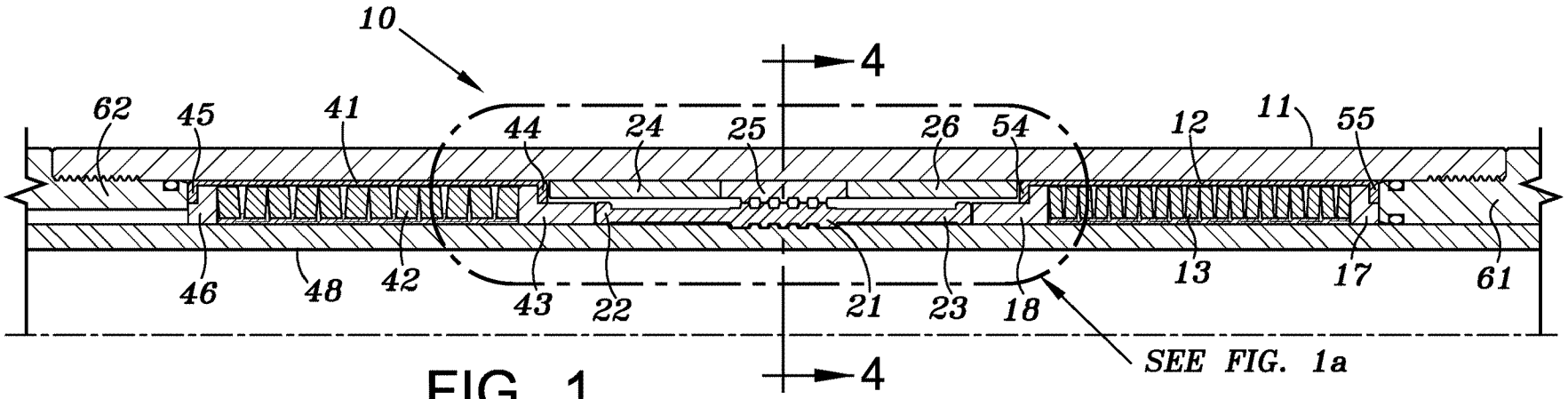
Figure 4:
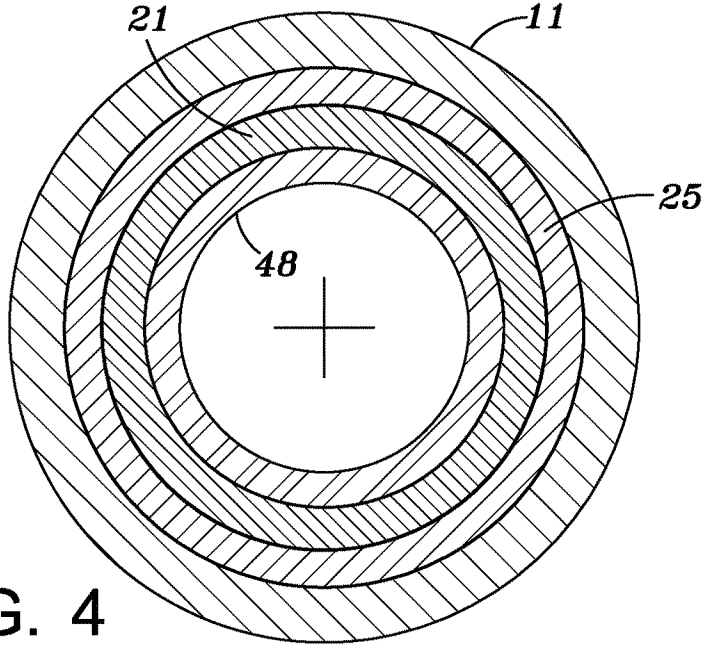
FIG. 4 is a cross-sectional view of the release device taken along lines 4-4 of FIG. 1.

Referring to FIG. 1, an embodiment of the release device 10 includes a first annular outer housing member 11 and second and third housing members 62 and 61 threadably attached to housing member 11. Unless otherwise stated, it should be understood that the elements shown in the figures are annular members that surround the central tubular mandrel 48 of the jarring device as shown in FIG. 4.

A first Belleville spring stack 42 is confined within a first split ring housing 41 by flanges 45 and 44. Housing 41 is formed by two semi-circular members so that they can be positioned over and surrounding spring 42 after spring 42 has been compressed. Bushing 43 has a first portion 81 that engages the end of Belleville spring stack 42 and a second portion 82 that engages collet 21 at 22 as shown in FIG. 1*a*.

An annular collet 21 having a first end 22 and a second end 23 is positioned on mandrel 48 and includes a plurality of grooves 30 and ridges 29 as in known in the art. Collet 21 may include a plurality of longitudinally extending slots to facilitate radial expansion of the collet. The outer surface of mandrel 48 includes a plurality of grooves 33 and ridges 32 that in the neutral position of FIG. 1 engage with the ridges 29 and grooves 30 of the collet. In this position mandrel 48 is restrained from axial movement by virtue of bushings 43 and 18 and springs 42 and 13.

A second Belleville spring stack 13 is confined within a second slit ring housing 12 by virtue of flanges 54 and 55 and bushings 18 and 17. Second Belleville spring stack 13 may be precompressed to a value greater or less than or equal to that of first Belleville spring stack 42. Spring stacks 42 and 13 may include a plurality of spring guides 84 and 85 as disclosed in U.S. Pat. No. 7,854,425 issued Dec. 21, 2010.

Figure 1A:
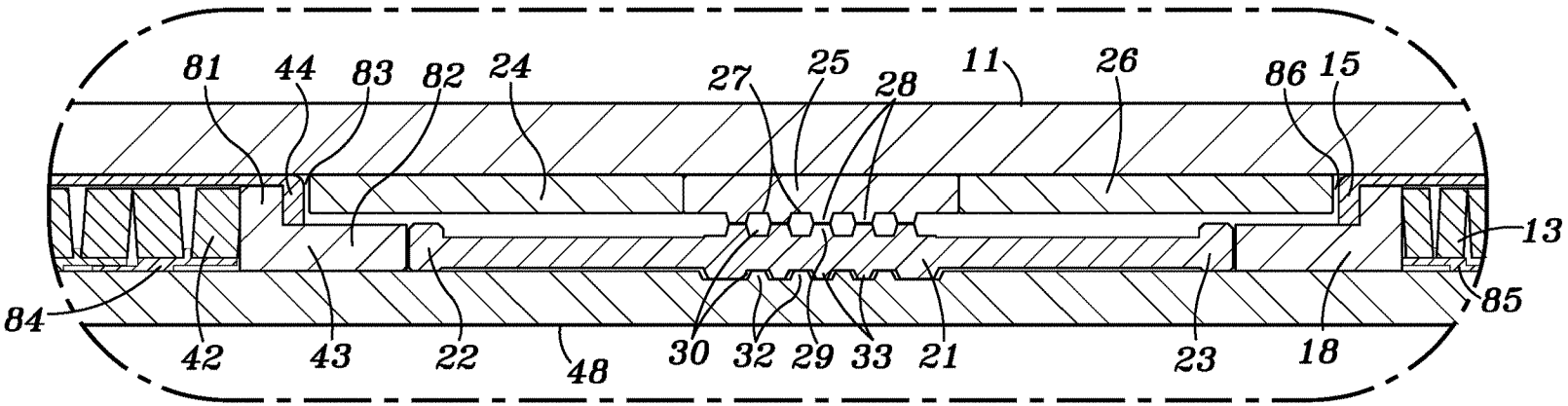

Three concentric sleeve members 24, 25 and 26 surround collet 21 and mandrel 48 and are positioned between collet 21 and housing 11 as shown in FIG. 1*a*.

Central sleeve 25 is a trigger sleeve that includes a plurality of annular grooves 27 and a plurality of annular ridges 28. Ridges 28 of trigger sleeve 25 rest on ridges 29 of collet 21 in the neutral position as shown in FIG. 1*a*. Sleeves 24, 25 and 26 are loosely confined in the space between housing 11 and annular collet 21; that is they are not secured structurally to any member.

Figure 2:
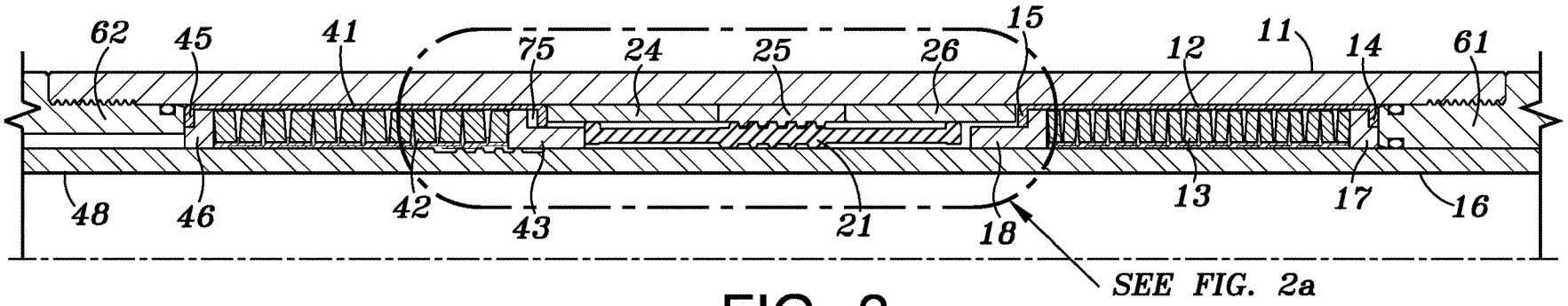

In the neutral position shown in FIG. 1*a*, springs 42 and 13 are under compression and will resist movement of the collet 21 in both directions that is in an upwardly or downwardly direction. Assuming that motion of the mandrel 48 to the left as shown in FIG. 2 constitutes an upward movement, as an upward force is placed on the mandrel 48 via a tubular string, collet 21 cannot move to the left until the force exerted by spring 42 stack and bushing 43 on the collet at 22 is overcome. Thus, collet 21 will not move to the left until a predetermined force is exceeded.

In the neutral or unloaded position there is a gap between the sleeves 24, 25 and 26 and the split sleeves 41 and 12. As an axial load is applied in either direction, the angular engagement between the ridges 29 in the ID of the collet and the grooves 33 on the OD of the mandrel 48 cause the collet 21 to expand radially and engage the ID of the trigger sleeve 25. The frictional force between the OD of the ridges 29 of the collet 21 and the ID of the ridges 28 of the trigger sleeve 25 will cause the trigger sleeve 25 to be biased in the direction of motion of the collet 21. If a force is applied to the mandrel in the upward direction sufficient to exceed the preload of the spring stack 42 the sequence of operation would be 1) the mandrel would engage the collet and cause it to engage the bushing 43 and the spring stack 42; 2) the collet would expand such that the ridges 29 would engage the ridges 28 of the trigger sleeve 25 and cause the trigger sleeve 25 to load the sleeve 24 until the gap at 83 closes and a gap occurs at 86; 3) as additional load is applied the trigger sleeve 24 and sleeve 25 are prevented from upward motion by split housing 41 and housing member 62; 4) as additional load is applied the ridges 29 of collet 21 slide inside ridges 28 of trigger sleeve 25 until the ridges 29 of collet 21 come into registration with grooves 27 of trigger sleeve 25; and 5) at the point of registration the trigger sleeve will move in the opposite direction due to the gap at 86 and allow the collet to release without wear or damage. The load at which the mandrel is released is known as the trigger load or release load and will be somewhat greater than the preload.

After the collet 21 releases the mandrel 48 the spring stack 42 will be compressed to the release load which will be slightly greater load than the preload due to the additional compression of the spring stack as shown at 75 in FIG. 2. The release load is maintained because the spring stack 42 is compressed between annular bushings 46 and 43. Bushing 43 abuts housing member 62 and is thus restrained from upward movement. Ring 43 transfers the release load to the collet 21. Collet 21 is engaged with trigger sleeve 25 which causes the trigger sleeve 25 to load sleeve 26 which loads the split housing 12 and finally the load is transferred to housing member 61. There will be some drag on the mandrel 48 as it moves through the collet 21 because the release load is acting on the collet 21 and trigger sleeve 25. The angular faces of the protrusions 28 in the trigger sleeve 25 and the mating ridges 29 of the collet will cause the collet to collapse and create a drag force as the mandrel 48 moves through the collet 21.

If a force were applied to mandrel 48 in a direction opposite to that shown in FIG. 2, then mandrel 48 would move to the right as shown in FIG. 2 and a similar release of the mandrel from collet 21 would occur. In this case, spring stack 13 would be compressed by collet 21 through annular bushing 18.

Figure 3:
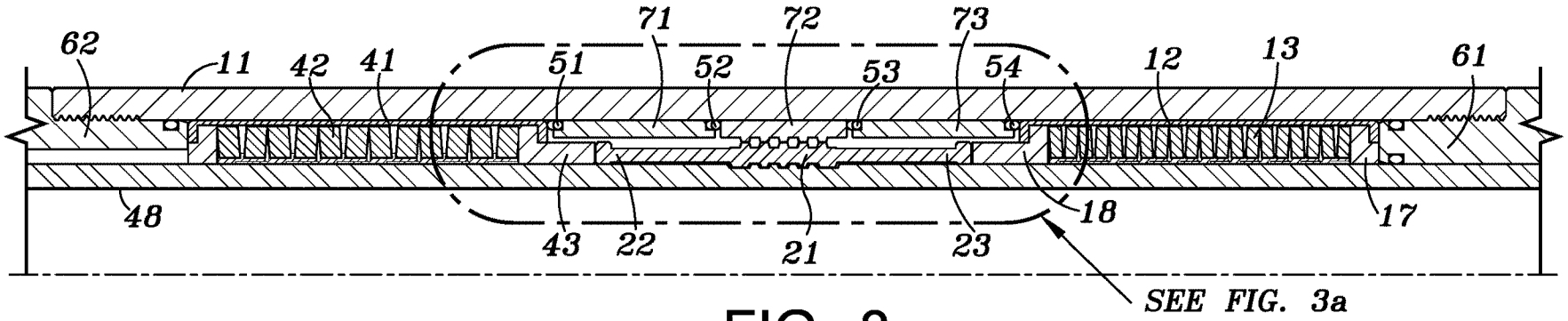
Figure 3A:
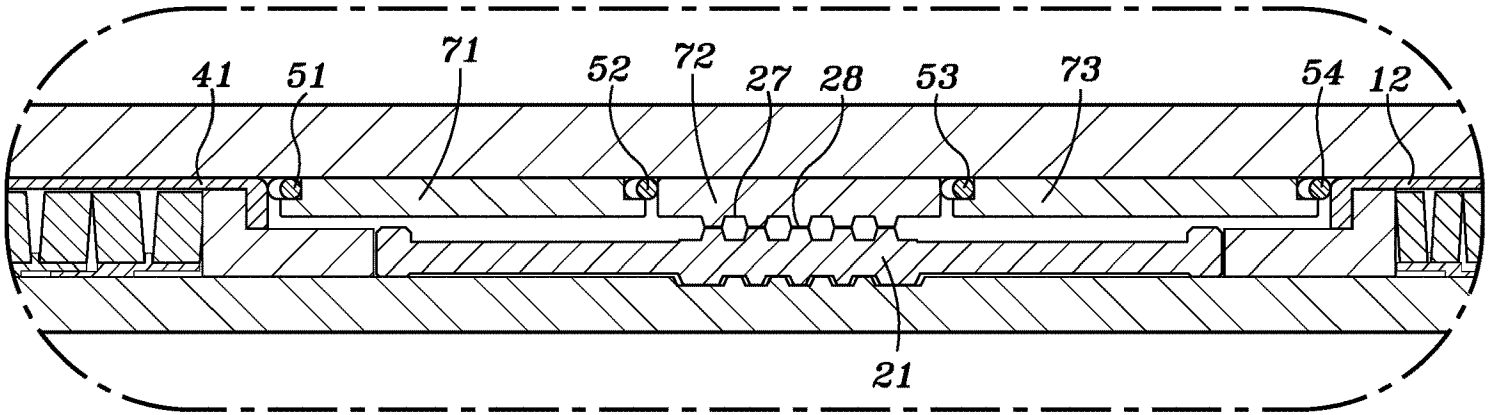

FIGS. 3 and 3*a* illustrate a second embodiment according to the invention. This embodiment is similar to that shown and described in FIGS. 1 and 1*a* in that it includes housing 11, 61 and 62, spring stacks 42 and 13, split ring housings 41 and 12, bushings 46, 43, 19 and 17, mandrel 48 and collet 21. It also includes three concentric sleeves 71, 72 and 73. Sleeve 72 is also a trigger sleeve.

A plurality of annular round wire wave springs known as Wavo® springs 51, 52, 53 and 54 are positioned between split housing 41, sleeves 71, 72 and 73 and split housing 12 as shown in FIG. 3*a*.

Figure 2A:
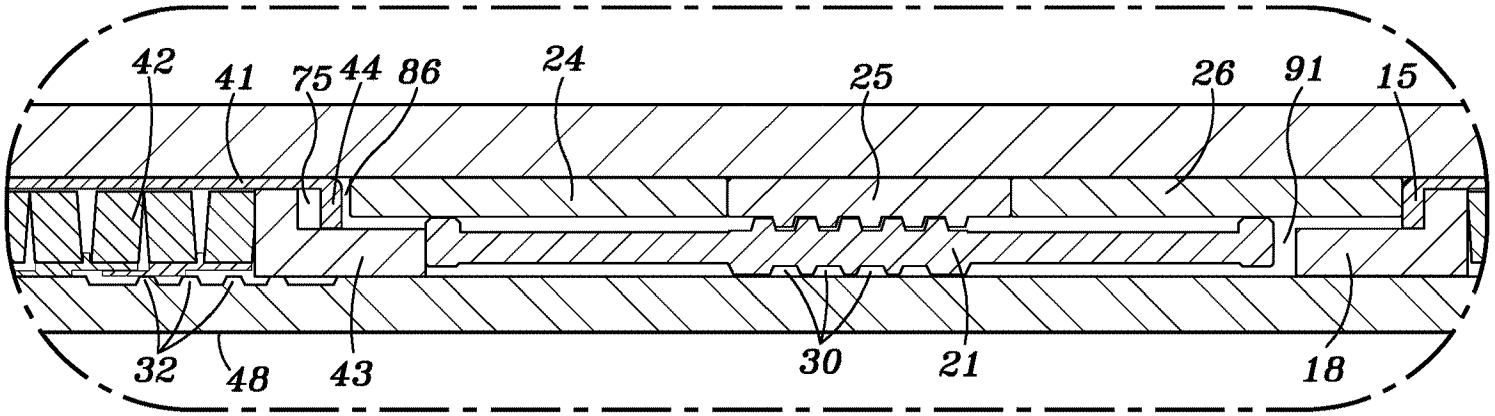

The operation of the collet and trigger sleeve are similar that shown in FIGS. 1 and 1*a*. As the mandrel begins to compress the collet between the mandrel grooves and the bushing 43 the collet expands and causes the trigger sleeve to move with the collet due to the friction force between the OD of the ridges 29 of the collet and the ridges 28 of the trigger sleeve. The friction force between the collet and trigger sleeve will cause springs 51 and 52 to become compressed until the trigger sleeve bears on sleeve 71 which in turn bears on split sleeve 41 and housing member 62. At this point the collet will move relative to the trigger sleeve until the mandrel moves to the release point where the OD ridges 29 of the collet are in registration with the ID grooves 27 of the trigger sleeve. At this point the spring stack 42 is compressed as shown in 75 in FIG. 2*a*. The trigger sleeve will instantly release the collet as previously explained. However, the addition of the Wavo® springs allow the spring stack 42 to compress the springs at 53 and 54 as shown in FIG. 5*a* until the load of the spring stack 42 is again trapped between the flanges 45 and 44 of split housing 41. The Wavo® springs pushing on the trigger sleeve and collet will cause the collet to collapse and drag on the mandrel but the magnitude of the drag force will be reduced by a factor of at least 10.

FIG. 6 illustrates a complete jarring tool utilizing the release mechanism of FIGS. 1 and 2. The release mechanism could also be used in conjunction with the embodiment of the release mechanism shown in FIGS. 3-5.

Referring to FIG. 6 the jarring tool includes a housing having upper portions 102 and 103, middle portion 11, 112 and a lower portion 111. Connector 110 and threads 115 are provided for connecting the lower end of the jarring tool to a tubular string. The jarring tool also includes a mandrel having an upper portion 49, a middle portion 48 and a lower portion 114.

The upper portion 49 is connected to a connector 101 for attaching the upper portion of the jarring tool to a tubular string.

The various portions of the housing are connected together for example by threads 122, 123, 125, 126, 128 and 129. The individual portions of the mandrel are connected together for example by threads 124 and 127. Seals are located between the housing and mandrel portions at 131, 132, 133, 134, 135, 136, 137 and 138.

A floating piston 116 surrounds the lower portion 114 of the mandrel. Fluid fittings 114 and 115 are provided for introduction of suitable lubricants into the interior of the jarring tool as is well known in the art. With regard to surfaces that would impact based on an upward force, an anvil surface 105 is located at the end of housing portion 102, and a hammer surface 106 is located on the mandrel portion 49. With regard to surfaces that would impact due to a downward force, anvil surface 105 is located at the end of housing member 62 and hammer surface 106 is located on the mandrel portion 49 as shown in FIG. 6.

As shown in FIG. 7, upper portion 49 of the mandrel and the inner surface of housing member 103 may have a hexagonal cross-section as shown at 104 and 105.

FIG. 8 illustrates a third embodiment of the invention with respect to the arrangement of holding the pre-loaded springs in the housing. The elements that are the same as those in the embodiment of FIGS. 1 and 1*a* have been labeled the same. Referring to FIG. 8 an intermediate housing member 101 has an annular interior ridge 102 that together with shoulder 110 on housing member 62 and bushing 43 retains first spring stack 42.

Intermediate housing member 101 has an annual groove 103 which receives a segmented ring 107. Second spring stack 13 is confined between shoulder bushing 18 and shoulder 111 on housing member 61.

Spring stacks 42 and 13 are pre-loaded by threads 105 and 106 between intermediate housing member 101 and housing members 62 and 61.

MODE OF OPERATION

In the neutral position shown in FIG. 1, collet 21 locks mandrel 48 in place via the grooves and ridges of the collet and the mandrel. Movement of the collet in an upward or downward direction is resisted by springs 42 and 13 which are precompressed and exert a force on the collet by virtue of bushings 43 and 18. If a force greater than the compression force of spring 42 is exerted in an upward direction (or to the left as shown in FIG. 1) on mandrel 48, collet 21 and mandrel will begin to move to the left while further compressing spring 42. As the ridges 29 of collet 21 come into registry with grooves 27 of the trigger sleeve, collet 21 will expand outwardly thereby releasing the collet from the mandrel. The mandrel will then be free to exert a jarring force as it moves the position of FIG. 2. In a similar manner, if a downward force is applied to the mandrel that exceeds the compression force of the spring, collet 21 will compress spring 13 and the collet will then separate from the mandrel and expand into the trigger sleeve. The embodiment of FIGS. 3 and 3*a* operates in the same manner. However, when an upward force is put on the mandrel and the mandrel is released as shown in FIGS. 5 and 5*a*, Wavo® springs 53 and 54 will be compressed so that no gap similar to that shown at 75 exits. Thus the force is transmitted through collet 21 and trigger 72 thereby compressing springs 53 and 54. Consequently the force on the collet and trigger sleeve is from Wavo® springs 53 and 54, not through spring 43, which would be considerably higher.

As is understood in the art, the grooves and ridges of the trigger sleeve, collet and mandrel are angled so that their respective surfaces can slide with respect to each other.

Although the present invention has been described with respect to specific details, it is not intended that such details should be regarded as limitations on the scope of the invention, except to the extent that they are included in the accompanying claims.

What is claimed is:

1. A release device for a jarring mechanism comprising:
an outer housing,
a preloaded spring positioned within the outer housing,
a mandrel positioned within the outer housing,
an annular collet surrounding an outer surface of the mandrel, axial movement of the collet being resisted by the spring, and
an annular trigger sleeve surrounding the collet, said annular trigger sleeve positioned between annular round wire wave springs and adapted to move freely in an axial direction by virtue of a gap between the trigger sleeve and a split ring housing surrounding the preloaded spring, the collet including means for releasably engaging the mandrel.

2. The release device as claimed in claim 1 further including: a second preloaded spring within the outer housing.

3. The release device as claimed in claim 1 including a bushing having a first portion located within the housing that abuts against the preloaded spring and a second portion that engages the collet.

4. The release device of claim 1 wherein the annular trigger sleeve is adapted to move in a direction opposite to the direction of the collet when the mandrel is at a release point.

5. The release device of claim 1 wherein as the trigger sleeve engages the collet, the trigger sleeve moves axially and abuts the split ring housing surrounding the spring, thereby closing the gap.

6. A bidirectional jarring tool comprising:
a housing,
a pair of preloaded jarring force springs positioned within the housing,
a mandrel axially moveable within the housing,
a single collet positioned between the pair of springs and surrounding the mandrel, and
a single trigger sleeve surrounding the collet, the trigger sleeve being positioned between annular round wire wave springs and mounted for axial movement in two directions within the housing,
the mandrel including a hammer surface and the housing including an anvil surface.

7. The jarring tool of claim 6 further including a pair of sleeve members, one of the sleeve members of the pair of sleeve members disposed on each side of the trigger sleeve and surrounding the collet; a pair of split ring housings, one split ring housing of the pair of split ring housings confining each preloaded jarring force spring; there being a gap between each split ring housing and the respective sleeve member.

* * * * *